US005691521A

United States Patent [19]

Komuro et al.

[11] Patent Number: 5,691,521

[45] Date of Patent: Nov. 25, 1997

[54] VACUUM CIRCUIT BREAKER WITH IMPROVED CONTACT ASSEMBLY

[75] Inventors: Katsuhiro Komuro; Yoshitaka Kojima; Yukio Kurosawa; Shunkichi Endoo; Tooru Tanimizu; Yoshimi Hakamata; Katsumi Kuroda, all of Hitachi, Japan

[73] Assignee: Hitachi, Ltd., Tokyo, Japan

[21] Appl. No.: 419,542

[22] Filed: Apr. 10, 1995

[30] Foreign Application Priority Data

Apr. 11, 1994 [JP] Japan ..... 6-098252

[51] Int. Cl.[6] ..... H01H 33/66

[52] U.S. Cl. ..... 218/123; 218/127; 218/129; 218/130; 218/132

[58] Field of Search ..... 200/264, 275, 200/279; 218/123–126, 127–129, 130–135

[56] References Cited

U.S. PATENT DOCUMENTS

| | | | |
|---|---|---|---|
| 4,427,857 | 1/1984 | Abe et al. | 218/129 |
| 4,473,371 | 9/1984 | Yorita | 218/123 |
| 4,584,445 | 4/1986 | Kashiwagi et al. | 218/130 |
| 4,588,879 | 5/1986 | Noda et al. | 218/127 |
| 4,695,687 | 9/1987 | Grosse et al. | 218/127 |
| 5,064,976 | 11/1991 | Bialkowski et al. | 218/127 |
| 5,420,384 | 5/1995 | Okutomi et al. | 200/264 X |
| 5,495,085 | 2/1996 | Yorita et al. | 218/123 |
| 5,557,083 | 9/1996 | Komuro et al. | 218/125 |
| 5,597,993 | 1/1997 | Yorita et al. | 218/129 |

FOREIGN PATENT DOCUMENTS 5-6780 1/1993 Japan .

*Primary Examiner*—J. R. Scott

*Attorney, Agent, or Firm*—Fay, Sharpe, Beall, Fagan, Minnich & McKee

[57] ABSTRACT

A vacuum switch having a fixed side electrode unit and a movable side electrode unit mounted in a vacuum vessel. Each electrode unit includes an arc electrode, an arc electrode supporting member for supporting the arc electrode, a coil electrode and a conducting rod. Joining portions between the arc electrode and the arc electrode supporting member, the coil electrode and the conducting rod are integrally and directly formed metallurgically by solid phase diffusion using a hot isostatic process. A vacuum circuit breaker may be constructed incorporating the vacuum switch.

12 Claims, 8 Drawing Sheets

VACUUM CIRCUIT BREAKER WITH IMPROVED CONTACT ASSEMBLY

BACKGROUND OF THE INVENTION

1. Field of the Invention

The present invention relates to a vacuum switch or valve and a method for manufacturing the vacuum switch or valve and a vacuum circuit breaker having a vacuum switch or valve and a method for manufacturing the vacuum circuit breaker.

In particular, the present invention relates to a vacuum switch or valve having a high reliability electrode structure and a method for manufacturing the vacuum valve and a vacuum switch or circuit breaker having a high reliability electrode structure and a method for manufacturing the vacuum circuit breaker so as to obtain a vacuum circuit breaker capable of withstanding a high voltage and for performing a cut-off of a large current.

2. Prior Art

A conventional vacuum circuit breaker having a high voltage and for performing a cut-off with a large current comprises a vacuum switch or valve having a pair of a fixed side electrode unit and a movable side electrode unit in a vessel, which is maintained under an insulated and a high vacuum condition, conductor terminals connected to the fixed side electrode unit and the movable side electrode unit outside of the vacuum valve, and an opening and closing means for driving the movable side electrode structure through an insulating member being connected to the movable side electrode unit. An electrode structure comprises the fixed side electrode unit and the movable side electrode unit.

Each of the above stated fixed side electrode unit and the movable side electrode unit commonly comprises four electrode unit component members, respectively. The four electrode unit component members comprise an arc electrode member, an arc electrode supporting member for supporting the arc electrode member, a coil electrode member connected to the arc electrode supporting member and for operating to disperse the arcs overall on the arc electrode member, and an electrode or conducting rod provided on an end portion of the coil electrode member.

Further, in the above stated electrode structure a reinforcement member for increasing the strength of the electrode structure may be added for practical use. The above stated arc electrode member is directly exposed to the arcs so as to open-close and cut-off the high voltage and the large current.

The following characteristics are required for the arc electrode member. Such characteristics are exemplified by a large cut-off capacity, a high withstanding voltage value, a small contact resistance value (a superior electric conduction), a superior anti-fusion characteristic, a small contact consumption and a small cut-off current value.

In the conventional electrode structure, the electrode unit is manufactured through a method in which one or more of Cr, Cu, W, Co, Mo, V, Nb or one or more alloy powders thereof is formed and sintered with a predetermined composition, shape and vacancy volume, and after that a molten Cu or Cu alloy is infiltrated into a skeleton of a sintering body. (Hereinafter, it is called "an infiltration method").

So as to improve the withstanding voltage value within the above stated various characteristics, a method for manufacturing the arc electrode member according to a hot isostatic press (hereinafter, it is abbreviated to "HIP") processing as disclosed in, for example, Japanese patent publication No. 6780/1993. In this HIP processing, the density is increased in the sintering process before the infiltration process, and the vacancy rate is lessened.

The arc electrode member manufactured according to the above stated hot isostatic press (HIP) processing has a higher withstanding voltage and further the scattering of the withstanding voltage value due to each product becomes small, in comparison with the arc electrode member manufactured according to the infiltration of the molten Cu alloy melting metal.

In the conventional electrode structure manufacturing technique, irrespective of the manufacturing method for the arc electrode member according to the infiltration method or according to the hot isostatic press (HIP) method, four electrode unit component members for comprising the electrode unit are manufactured for each component member and are carried out under the mechanical processing and after that the four component members are carried out to the soldering joining process, then the electrode structure is completed.

The above stated four component members for comprising the electrode unit are the arc electrode member, the arc electrode supporting member for supporting the arc electrode member, the coil electrode member connected to the arc electrode supporting member and the electrode or conductive rod provided on the end portion of the coil electrode member.

The soldering joining process is carried out by a following method, between the arc electrode member and the arc electrode supporting member for supporting the arc electrode member, the coil electrode member connected to the arc electrode supporting member and the electrode rod provided on the end portion of the coil electrode member, a joining material and a soldering member having a good wetting characteristic are inserted, by raising the temperature in a vacuum or a reduced atmosphere. Accordingly, the soldering joining process is carried out.

In the electrode structure constituted according to the soldering joining process, it takes a long time for carrying out the mechanical processing process for the respective component member and also a long time for carrying the sintering processing of the respective component member during the component member assembling for the soldering joining.

Further, in the above stated case, it causes accidents which destroy and cause drop out of the electrode unit component member due to the failure in the soldering joining. In the case of producing a vacuum circuit beaker having the higher voltage and the larger current in future, since the electric resistance of the soldering member in the joining portions is higher than that of the electrode unit, a problem may arise that a local exothermic phenomenon will occur.

Further, recently a measure for improving the cut-off performance and the improvement of the opening and closing speed of the vacuum circuit breaker has been attempted. When the opening and closing speed of the vacuum circuit breaker is high, during the opening and closing of the electrode unit component members the large impact stress is taken to the electrode component members, thereby deformation in the electrode unit component members may by generated.

For the above stated reasons, it causes a problem in the strength in the joining portions of the electrode unit component member of the electrode structure, in the conventional soldering joining, it causes concern about the adequay of the joining strength.

In the vacuum circuit breaker in response to the high voltage and the large current, the size of the arc electrode member is required to have a diameter of more than 100 mm.

However, by the conventional method for manufacturing the respective electrode unit component member according to the soldering processing, it is difficult to practically manufacture the arc electrode member having more than the above stated diameter of 100 mm from the aspect of yield, because of the shortage in the strength of the arc electrode member due to the failure in the soldering joining.

Further, at the arc electrode member and the arc electrode supporting member for supporting the arc electrode member, so as to disperse the arcs generated during the opening and closing of the electrode structure on the overall electrode structure and so as to improve the life of the electrode unit component members, plural grooves are formed at a side face portion of the electrode unit so as to generate a magnetic field parallel to a center axis of the electrode structure (a vertical magnetic field).

The above stated electrode structure having plural grooves is constituted by utilizing the phenomenon in which the current flows on the surface of the metal. Since the current flows along to a non-existent portion of the grooves, the spiral magnetic field generates around the current flow. Accordingly the above stated vertical magnetic field is generated.

Besides, so as to effectively generate the vertical magnetic field in the electrode structure, it is most effective that the above stated grooves continue to extend toward the side face portion of the arc electrode member and the arc electrode supporting member.

However, in the electrode structure according to the conventional soldering processing, when the grooves are formed across the interface of the soldering joining, during the arc generation the arcs reach as far as to the soldering face formed on a bottom portion of the groove, then the temperature at the soldering portion rises and a problem occurs in which the soldering member is melted out.

For the above stated reasons, in the conventional electrode structure, the grooves are formed only the side portion of the arc electrode supporting member. However, in this electrode structure, so as to generate the fully vertical magnetic field it is necessary to make the electrode structure itself large, and this is an obstacle for manufacturing a small electrode structure.

SUMMARY OF THE INVENTION

An object of the present invention is to provide a vacuum switch or valve and a method for manufacturing the vacuum switch or valve and a vacuum circuit breaker having a vacuum switch or valve and a method for manufacturing the vacuum circuit breaker wherein the vacuum switch or valve can be formed of a small size and have a long life due to the manufacture of an electrode structure without use of a soldering member, or the vacuum circuit breaker can be formed of a small size and have a long life due to the manufacture of an electrode structure without use of a soldering member.

So as to attain the above stated object, in the present invention, a vacuum switch or valve comprises a vacuum vessel for forming a vacuum chamber, a fixed side electrode unit provided in the vacuum vessel, and a movable side electrode unit provided in the vacuum vessel; and a vacuum circuit breaker comprises an insulated vessel, a vacuum valve having a fixed side electrode unit and a movable side electrode unit, conductive terminals connected to each of the fixed side electrode unit and the movable side electrode unit outside of the vacuum valve, an insulating member connected to the movable side electrode unit, and an opening and closing means for driving the movable side electrode unit through the insulating member.

So as to attain the above stated object, in the present invention, in the vacuum valve or in the vacuum circuit breaker comprising an arc electrode member, an arc electrode supporting member, a coil electrode member and an electricity supply member or conducting rod, at least one of joining base members in the joining portions between the arc electrode member and the arc electrode supporting member and between, the coil electrode member and the electricity supply member or conducting rod is integrally and directly formed by solid phase diffusion using a hot isostatic process.

As a desirable one of the above stated electrode structure, the arc electrode member is comprised of at least one of metal components selected from a group containing 80–30% by weight of one or more of Cr, W, Mo, Co and Fe.

Further, it is preferable to select the arc electrode member from at least one of metal components selected from a group containing 0.5–5% by weight of one of more of V, Nb, Zr, Ti, Ta and Si and at least one of alloys of metal components selected from a group containing 20–70% by weight of one or more of Cu, Ag and Au.

It is preferable to select each of the arc electrode supporting member, the coil electrode member and the electricity supply member from at least one of metal components selected from a group containing less than 1.0% by weight of one or more of Cr, V, Zr, Si, W and Be and the remainder is selected from an alloy of at least one of metal components selected from a group of one or more of Cu, Ag and Au.

In the above stated electrode structure for use in the vacuum valve or in the vacuum circuit breaker, each of the arc electrode member and the arc supporting member has plural grooves for generating a vertical magnetic field, and the plural grooves continue to extend toward a side face portion of the arc electrode member and the arc electrode supporting member.

At least one of the base members in the joining portions between the arc electrode member and the arc electrode supporting member and between the coil electrode member and the electricity supply member is integrally and directly formed by solid phase diffusion, thereby the performance in the vacuum valve or in the vacuum circuit breaker can be further improved.

Further, in the above stated electrode structure for use in the vacuum valve or in the vacuum circuit breaker, at least one of the joining portions between the arc electrode member and the arc electrode supporting member and between the coil electrode member and the electricity supply member is integrally manufactured using hot isostatic press (HIP) processing.

In the above stated vacuum valve or vacuum circuit breaker manufacturing method, the heating is carried out under the heating temperature of the hot isostatic press (HIP) processing which is less than that of a melting point of an alloy comprised of at least one of metal components selected from a group of one or more of Cu, Ag and Au constituting a base member, and it is desirable to integrally form the metal base member.

In the above stated vacuum switch or valve or vacuum circuit breaker manufacturing method, it is desirable to include further a process for inserting various kinds of metal powders into a metal capsule and for closely sealing by heating and degassing an interior portion of the metal capsule. This process is commonly called a "canning" process.

In the electrode structure of the vacuum valve for use in the vacuum circuit breaker, at least one of the joining portions of the base members between the arc electrode member and the arc electrode supporting member and between the coil electrode member and the electricity supply member is integrally formed according to the hot isostatic press (HIP) processing.

Four electrode unit component members for comprising the electrode unit are the arc electrode member as one member and three members which are joined to the arc electrode member. The four component members are comprised of the arc electrode member as one component member and the arc electrode supporting member, the coil electrode member and the electricity supply member or conductive rod as three component members.

Accordingly, at least two electrode component members, which are the arc electrode member and at least one selected from the above stated three electrode unit component members, can be joined to each other by a metallurgical method without the soldering processing.

In the above case, the strength of the joining portion comes up as a problem. However, when the base member (Cu alloy) is integrally formed by solid phase diffusion, then the strong strength will be fully obtained and a problem about the exothermic phenomenon at the joining portion during use will not occur.

In the present invention, the meaning of the continuation in the metallography or the integration in the metallography according to the solid phase diffusion in as follows.

Namely, as shown in FIG. 7 or FIG. 8, in the joining portion of the above stated base members comprised of the arc electrode member and one of the three component members, the crystallization (crystallization grew in prismatic, mono-crystallization one by one) of the base member (in this case, a pure Cu) continues to the joining portion, and it shows a condition in which a joining boundary portion is unclear.

In the case in which the base member is integrally formed by solid phase diffusion processing, the shape of the metal having the high melting point such as Cr, which is dispersed in the base member, is characterized by keeping the shape in the raw material powder as it is.

Namely, since the particle diameter of the raw material powder is made small through the crushing work etc., many particle shapes are angular. In the case of the employment of solid phase diffusion processing, the sintering temperature is low. Since the metal having high temperature melting point such as Cr hardly reacts, the particle shape of the metal is left to hold the angular shapes.

Besides, the joining portion of the base member can be integrally formed by fusing and impregnating the base member. However, in the above case, because of the processing under the high temperature, a part of the metal having high melting point such as Cr reacts, thereby the particle shape becomes round. The above differences will be explained referring to FIG. 2 and FIG. 3.

FIG. 2 is a photograph showing a metallurgical structure of a joining part using HIP processing according to the present invention. FIG. 3 is a photograph showing a metallurgical structure of a joining portion according to the conventional infiltration method. In these figures, a dense color portion shows Cr particles, and a white matrix portion shows Cu alloy.

In the case in which the part of the metal having the high melting point reacts, since the element such as Cr is diffused into Cu alloy, the electric conductivity of the base member becomes low. In the electrode material used in the electrode structure, because of the high voltage and the large current flow, the slight lowering in the electric conductivity relates to the generation of the energy loss. Accordingly, the lowering in the electric conductivity is undesirable.

The base member integrally formed according to the solid phase diffusion processing can be adopted more than two electrode unit component members from four electrode unit component members comprised of the arc electrode member and one of three component members. However, the part of the joining portion can be formed through the soldering joining from the aspect of the relationship of the cost for manufacturing of the electrode structure.

Further, by integrally manufacturing the electrode structure according to the hot isostatic press (HIP) processing, it is possible to make the material for the arc electrode member to have any composition gradient. This is impossible using the prior technique.

As a result, the thermal stress due to the difference of coefficient of thermal expansion of each material in the electrode structure can be mitigated and further the occurrence due to the thermal stress during the use of the electrode structure can be restrained.

During the use of the electrode structure since the current flows always, so as to make as small as possible the loss of the electric energy, it is preferable to use the material having a small resistance. In the pure Cu, since the melting point thereof is lower than the arc temperature, the pure Cu easily is melted down and fused during the practical use.

Within the range in which the electric resistance increases as little as possible, as the element for improving the fusion property, the element (metal) comprised of one of more of Cr, W, Mo, V, Nb, Zr, Ta, Ti, Si and Co is used from the past. These metals are the same ones used in the conventional electrode structure.

These metals have the high melting point of more than 1800° C., and the simple substance of a group of Cr, W, Mo, V, Nb, Zr, Ta, Ti, Si and Co etc. is used, or more than two kinds of alloys selected from the above group is used to add Cu etc. being the base member.

It is preferable to have the total amount containing 20–70% by weight. With to the vacuum circuit breaker required for obtaining the high speed of the cut-off speed and the strong strength, it is desirable to increase or reduce the total amount in response to the requirement characteristic of the electrode structure.

The total containing amount of more than one kind of the element selected from a group containing a range of 0.2–5% by weight of one or more of V, Nb, Zr, Ta, Ti and Si is added and further as the conductive material it is preferable to employ the total amount of more than one kind of the alloy powder selected from a group containing 30–80% by weight of one or more of Cu, Ag and Au.

These elements can form the intermetallic compound having the high melting point with Cu etc. and are added so as to improve the anti-fusion property and the cut-off characteristic from the past. These elements are used by adjusting the kind and the amount in response to the requirement characteristic of the electrode structure.

In the arc electrode member the arcs generate during the opening condition of the electrode structure, the arcs commonly generate from the portion in which the high current flows.

When the foreign matters such as the abrasion powders are laid on the electrode structure, the arcs generate in the highest priority from the closest distance portion of the fixed side electrode unit and the movable side electrode unit. This portion goes to decay in the highest priority and a problem occurs in that the whole life of the electrode structure is shortened.

So as to prevent the above stated inconveniences, from the past, the magnetic field in parallel to the electrode axis is applied so as to uniformly generate the arcs from the whole surface of the electrode unit. This is called the vertical magnetic field and the coil electrode member is provided at the vicinity of the electrode unit so as to generate the vertical magnetic field.

Each of FIGS. 4A and 4B shows a view of a conventional electrode structure. FIG. 4A is a horizontal cross-sectional view of the electrode structure and is a horizontal cross-section along a line 4B—4B in FIG. 4B. The arc electrode member is joined to the arc electrode supporting member through a soldering face 92 by the soldering joining processing.

FIG. 4B is a view taken from an upper side of a coil electrode member 91. The current flows in parallel to a four-divided arc electrode face along to the coil electrode member 91 and generates the vertical magnetic field. The four-divided current flows to the arc electrode member from the arc electrode supporting member 94 and a soldering face 95. As stated above, by the provision of the grooves, a vertical magnetic field is generated.

The grooves, as shown in FIGS. 4A and 4B, in the electrode structure according to the conventional soldering joining processing, are merely provided from the soldering face 92 to a lower portion (in FIG. 4A, to a line indicated by 4A—4A). Namely, in this case the electrode structure does not have the grooves extending from the arc electrode member to the arc electrode supporting member.

Because the grooves reach to the soldering face, in the electrode structure according to the conventional soldering joining processing, the arcs generated during the opening condition of the electrode structure reach to the soldering portion of the bottom portions of the grooves, and then the soldering member is melted down.

By employing the solid phase diffusion processing according to the present invention, in the integral electrode structure without the employment of the soldering joining processing, the grooves are provided to the electrode unit face, and the meltdown of the soldering member does not occur.

From the above stated aspects, it is most desirable to integrally form the respective electrode unit member comprised of the arc electrode member, the arc electrode supporting member, the coil electrode member and the electrode rod according to the solid phase diffusion method.

According to the present invention, as shown in FIG. 5, plural grooves 50 are provided to extend from the surface of an arc electrode member 31 to a side portion of an arc electrode supporting member. In FIG. 5, the electrode structure comprises further a coil electrode member 33 and an electrode rod 34.

By the provision of the plural grooves 50 extending to the surface of the electrode unit, in comparison with the electrode structure in which the grooves do not reach to the surface of the electrode unit, the strength in the vertical magnetic field generated in the electrode structure is made large. Thereby in the present invention the diffusion property in the arcs can be improved.

Accordingly, the improvement in the life and the improvement in the withstanding voltage ability of the electrode structure can be attained. As a result, the improvement in the reliability of the electrode structure can be attained.

FIG. 5 shows a cup type electrode structure in which the arc electrode member 31 is formed with a doughnut shape. However, with respect to the common circular shape electrode structure, for example as shown in FIG. 13, in this circular shape electrode structure if the spiral shape grooves similarly shown in FIG. 5 can be provided, then the effects similarly to the above can be obtained.

Further, in the case of the vacuum circuit breaker having the same performances, compared with the electrode structure according to the conventional soldering joining method, the compact electrode structure can be obtained. Accordingly it is possible to obtain a compact vacuum circuit breaker.

The above is attained according to the integral forming method through HIP processing. The base member of the arc electrode member and the arc electrode supporting member comprised of the alloy of one or more of Cu, Ag and Au is formed with the integral structure metallurgically.

Further, in the integral manufacture for the electrode structure according to HIP processing, it is necessary to employ a heating temperature less than the melting point of the base member.

In the case in which the heating temperature is more than the melting point, this is not preferred since Cr etc. in the arc electrode member is diffused into the arc electrode supporting member and as a result the electric conductivity is lowered.

As the method for performing HIP processing in the electrode structure manufacture, the metal powder is inserted in the metal capsule, by heating and degassing the interior portion of the metal capsule and sealing the metal capsule. Accordingly almost all residual gases in the sintering body can be removed.

The existence of the residual gases is not preferable, because the residual gas in the sintering body is discharged from the electrode structure during the use of the vacuum circuit breaker and works to lower the vacuum degree in the vacuum circuit breaker.

DESCRIPTION OF THE INVENTION

Hereinafter, various embodiments according to the present invention will be explained.

Embodiment 1

Cr powder having a particle size of 44 μm–150 μm, Cu powder having a particle size of 44 μm–150 μm and Nb powder having a particle size of 44 μm–90 μm were mixed by V type blender and a mixed powder having 60% Cr-35% Cu-5% Nb in weight ratio was obtained.

The above mixed powder was filled in a metal mold and using a hydraulic press machine was formed under a pressure force of about 3000 kg/cm$^2$, as a result a compact body having a diameter of 60 mm and a thickness of 10 mm was obtained. A porosity of this compact body was 23–28% judging from the measurement of an bulk density.

Besides, only Cr powder having a particle size of 44 μm–150 μm was formed under a pressure force of about 2500 kg/cm$^2$ and a compact body having a diameter of 60 mm and a thickness of 50 mm was obtained. A porosity of this compact body was 22–27%.

A Cr-Nb compact body and a Cu powder compact body obtained according to the above processing were inserted by closely adhering in a soft steel capsule and after the vacuum sealing HIP processing was carried out.

The conditions of the soft steel capsule, the vacuum sealing processing and HIP processing were as follows. Using the soft steel capsule having a thickness of 3 mm, the heating of about 600°–700° C. was carried out. Performing the vacuum discharging and the degassing, the degassing was carried out to have a vacuum degree of until less than $5\times10^{-5}$ torr and after that the vacuum sealing processing was carried out.

The attention was fully paid about the clarification for the closely adhering face of Cr—Cu—Nb compact body and Cu powder compact body.

Figure 6:
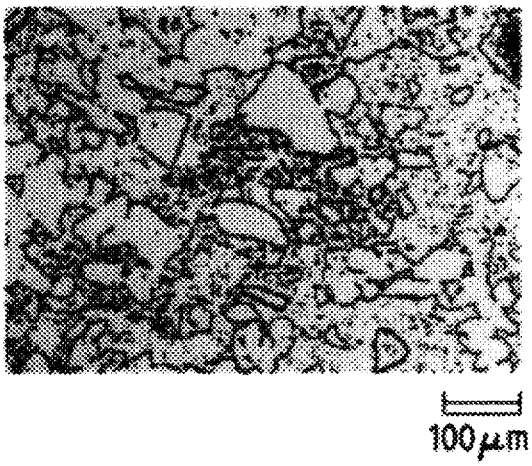
FIG. 6 is a photograph showing a metallurgical structure of a compact body comprised of 60 wt. % Cr-35 wt. % Cu-5 wt. % Nb obtained after HIP processing according to the present invention.
Figure 7:
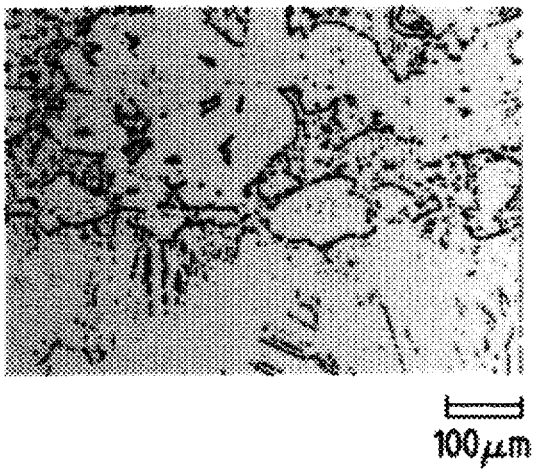
FIG. 7 is a photograph showing a metallurgical structure in a vicinity of a contacting interface of a compact body comprised of Cu—Cr—Nb compact body and Cu powder compacting body obtained after HIP processing according to the present invention.

FIG. 6 shows a metal organization observation result of Cr—Cu—Nb mixed compact body which was carried out through HIP processing. FIG. 7 shows a metal organization observation result of an interface of Cr—Cu—Nb mixed compact body and Cu powder compact body which were carried out through HIP processing.

Figure 2:
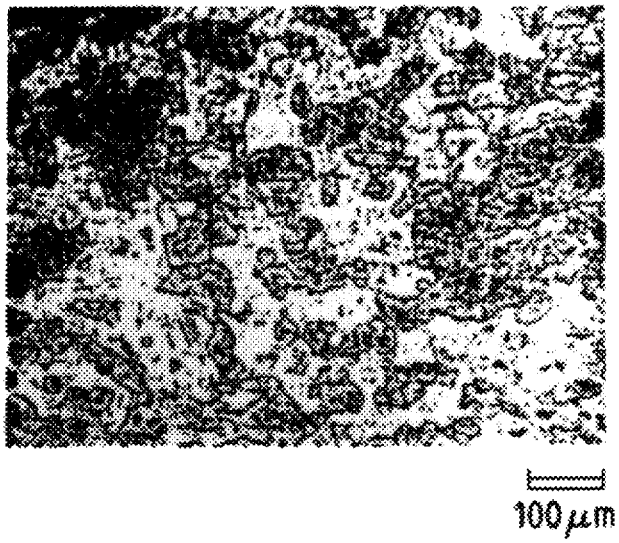
FIG. 2 is a photograph showing a metallurgical structure of an electrode structure obtained according to the present invention.
Figure 3:
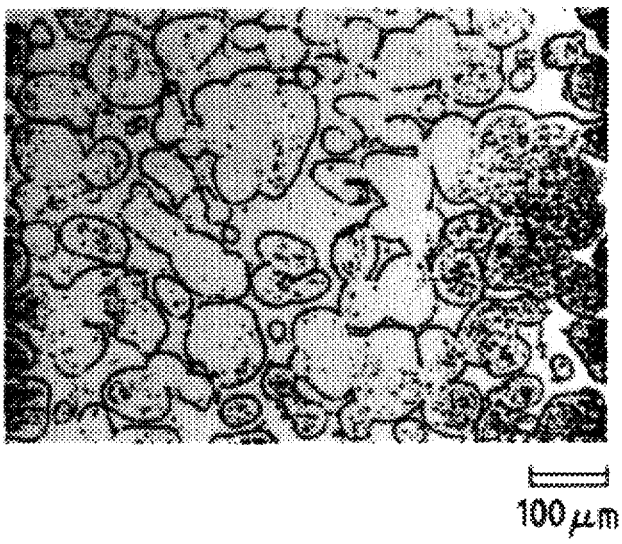
FIG. 3 PRIOR ART
FIG. 3 is a photograph showing a metallurgical structure of an electrode structure obtained according to the conventional method (infiltration method)
Figure 4A:
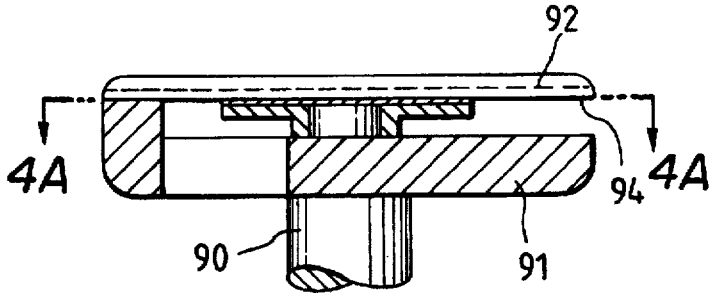
FIG. 4A PRIOR ART
FIG. 4A is a schematic cross-sectional view showing a conventional electrode structure.
Figure 4B:
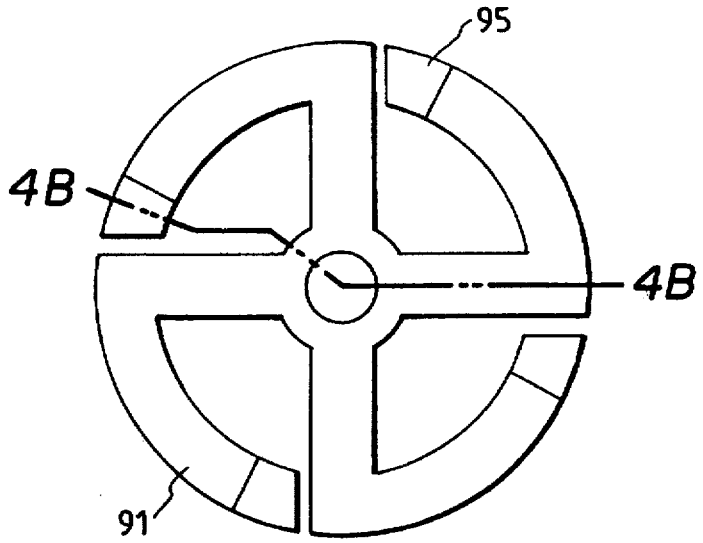
FIG. 4B PRIOR ART
FIG. 4B is a schematic top view showing a conventional electrode structure.

In these figures, similarly to FIGS. 2 and 3, a dark color particle shows Cr particle, and a white matrix shows Cu alloy. The above facts can similarly apply in the later stated photographs.

As shown in FIGS. 6 and 7, in Cr—Cu—Nb mixed compact body and Cu powder compact body which were carried out through HIP processing, no blow hole was observed and further by the solid phase diffusion method the approximate 100% theoretical density was obtained.

Further, as shown in FIG. 7, in the joining portion of Cr—Cu—Nb mixed compact body and Cu powder compact body, Cu base member was formed to constitute the integral structure in the metallography, in other words, in Cu base member the crystalline particle does not have any discontinuing boundary portion.

Further, so as to increase the strength in Cu powder compact body, in the case that the powder containing 0.8% by weight as a total amount of one or more of Cr, Ag, W, V, Nb, Mo, Ta, Zr, Si, Be, Co, Ti, Fe was added in Cr—Cu—Nb mixed compact body, it was confirmed that the same results stated in the above can be obtained.

Embodiment 2

Cr powder having a particle size of 44 μm–150 μm, Cu powder having a particle size of 44 μm–150 μm and Ta powder having a particle size of 44 μm–90 μm were mixed by V type blender. Then mixed powders were obtained to have 40% Cr-55% Cu-5% Ta; 35% Cr-61% Cu-4% Ta; 30% Cr-67% Cu-3% Ta; 25% Cr-73% Cu-2% Ta; 20% Cr-79% Cu-1% Ta; and 15% Cr-84% Cu-1% Ta, by weight ratio.

Next, using a metal mold having a diameter of 60 mm, at the first, 40% Cr-55% Cu-5% Ta mixed powder having a thickness of 0.5 mm was obtained. Next, 35% Cr-61% Cu-4% Ta mixed powder having a thickness of 0.5 mm was formed and was laminated.

Thus, a nine laminated layers composition compact body having a diameter of 60 mm and a thickness of 4.5 mm was obtained and in the above mixed powder, then Cu powder compact body was formed as a final layer.

Besides, separately from the above stated laminated compact body, only Cu powder is pressed under the pressing processing and Cu powder compact body having a diameter of 60 mm and a thickness of 40 mm was obtained.

By contacting Cu surface of the laminated compact body and Cu powder compact body, the canning process was carried out under the conditions of Embodiment 1. After that HIP processing was carried out under the temperature of 1000° C. and the pressure force of 2000 kg/cm$^2$.

Figure 8:
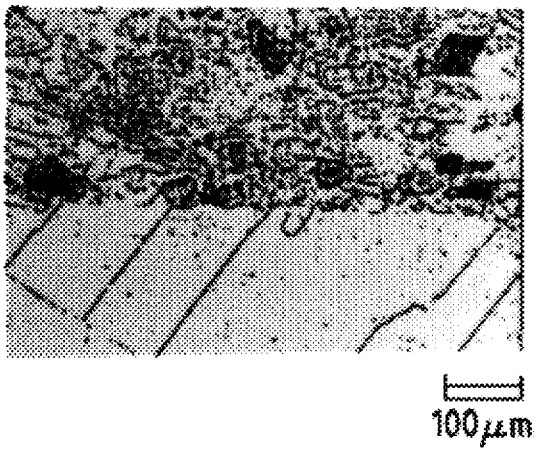
FIG. 8 is a photograph showing a metallurgical structure in a vicinity of a contacting interface of a laminated compact body comprised of Cu—Cr—Ta and a Cu powder compact body obtained after HIP processing according to the present invention.

FIG. 8 shows a metal organization observation result of a contacting portion of 15% Cr-84% Cu-1% Ta laminated compact body and Cu powder compact body. The laminated compact body and Cu powder compacting body were processed by HIP processing.

As shown in FIG. 8, the laminated surface of the respective composition or Cu surface contacting surface was minutely processed by the solid phase diffusion sintering and Cu base member was formed to constitute the integral structure in the metallurgically and further no boundary portion was seen.

Embodiment 3

Cr powder having a particle size of 44 μm–150 μm, Cu powder having a particle size of 44 μm–150 μm and Zr powder having a particle size of 44 μm–90 μm were mixed by V type blender and then a mixed powder containing 50% Cr-45% Cu-5% Zr by weight was obtained.

The mixed powder was carried out by the pressing processing under the pressure force of about 3000 kg/cm$^2$ and a compact body having a diameter of 60 mm and a thickness of 20 mm was obtained. The porosity of this compact body was the bulk density of 23–25%.

By contacting thus obtained 50% Cr-45% Cu-5% Zr compact body with a pure Cu rod having a diameter of 60 mm and a length of 30 mm, both were inserted in a soft steel capsule and after the vacuum sealing processing HIP processing was carried out. The vacuum sealing conditions and HIP processing conditions were similarly those of Embodiment 1.

Figure 9:
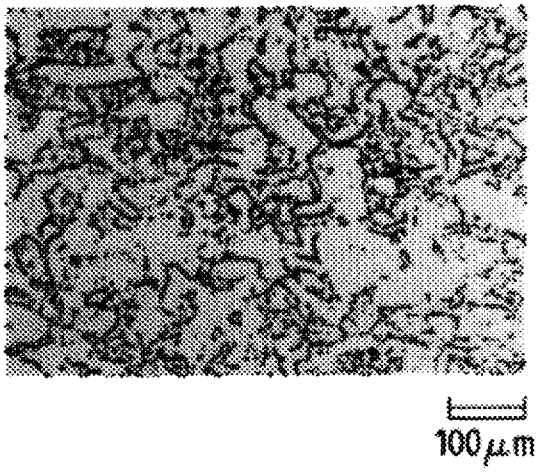
FIG. 9 is a photograph showing a metallurgical structure of a compact body comprised of 45 wt. % Cu-50 wt. % Cr-5 wt. % Zr after HIP processing according to the present invention.

FIG. 9 shows a metal organization observation result of a contacting portion of 50% Cr-45% Cu-5% Zr compact body which was processed by HIP processing.

Figure 10:
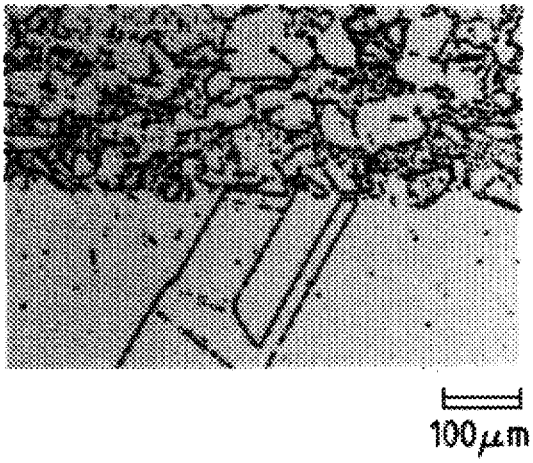
FIG. 10 is a photograph showing a metallurgical structure in a vicinity of a contacting interface of a compact body comprised of 45 wt. % Cu-50 wt. % Cr-5 wt. % Zr and a pure Cu rod obtained after HIP processing according the present invention.

FIG. 10 shows a metal organization observation result of a contacting interface of 50% Cr-45% Cu-5% Zr compact body which was processed by HIP processing and the pure Cu rod.

As shown in FIG. 9, Cr—Cu—Zr compact body and the pure Cu rod were minutely processed by the solid phase diffusion sintering. Besides, as shown in FIG. 10, at the contacting interface of Cr—Cu—Zr compact body and the pure Cu rod, Cu base member was formed to constitute the integral structure in the metallography, similarly to those of FIG. 8.

Further, in replace of the pure Cu rod, in the case in which Cu alloy rod containing 0.9% by weight as a total amount of one or more of Cr, Ag, W, V, Nb, Mo, Ta, Zr, Si, Be, Co, Ti and is used, it was confirmed that the similar results stated in the above were obtained.

In the case of Cu being added the above stated element, since the hardness and the strength of the material of the electrode unit are improved according to the age hardening processing, the deformation during the use time of the electrode structure is lessened.

However, accompanying to the increase in the addition amount, since the electric conduction characteristic becomes low, it is desirable to lessen the addition amount as possible.

According to the above stated Embodiment of the present invention, as seen from FIG. 7, FIG. 8 and FIG. 10, the arc electrode member, the arc electrode supporting member, the coil electrode member and the electrode rod (electricity supplying member) are formed to constitute the integral structure.

Accordingly, it can be judged that it is possible to manufacture the electrode structure having the joining portion in which the base member is integrally formed metallurgically.

Embodiment 4

Table 1 shows a relationship between HIP processing temperature and HIP processing pressure force with respect to the method practiced in Embodiments 1–3.

In Table 1, ○ mark shows the theoretical density ratio of more than 98% of the compact body, ● mark shows the theoretical density ratio of less than 97% and ◐ marks shows theoretical density ratio of about 97–98%.

TABLE 1

| HIP pressure (kg/cm$^2$) | HIP processing temperature (°C.) | | | | | | | |
|---|---|---|---|---|---|---|---|---|
| | 700 | 750 | 800 | 850 | 900 | 950 | 1000 | 1050 |
| 700 | | | | ○ | ○ | ○ △ | ○ △ | ○ △ |
| 800 | ● | | ● | | ▲ | | | |
| 900 | ● | ● | ◐ | ▲ | ◭ | | | |
| 1000 | ● | ◐ | ○ | ◭ | △ | | | |
| 1100 | ● | ○ | | △ | | | | |
| 1200 | ◐ | ○ | | | | | | |
| 1300–2000 interval (100 kg/cm$^2$) | ○ | ○ | ○ | ○ △ | ○ △ | ○ △ | ○ △ | ○ △ |

Further, △ mark shows a structure in which the base member is integrally performed in the metallurgically at the contacting interface, ▲ mark shows a structure in which the base metal is not joined and ◭ mark shows a structure in which the base member is partially integrally formed metallurgically at the contacting interface.

As shown in Table 1, in each of Embodiments 1–3 the theoretical density of the compact body extremely lowers at HIP temperature of less than 750° C. and HIP processing pressure force of less than 1000 kg/cm$^2$. However, in the case of HIP temperature of more than 800 ° C. and HIP processing pressure force of more than 1000 kg/cm$^2$, the theoretical density becomes more than 98%.

Besides, with respect to the contacting interface, it is seen that the base member in the contacting interface is integrally formed metallurgically at the temperature of more than 850° C. and the pressure force of more than 1100 kg/cm$^2$.

Embodiment 5

Figure 11:
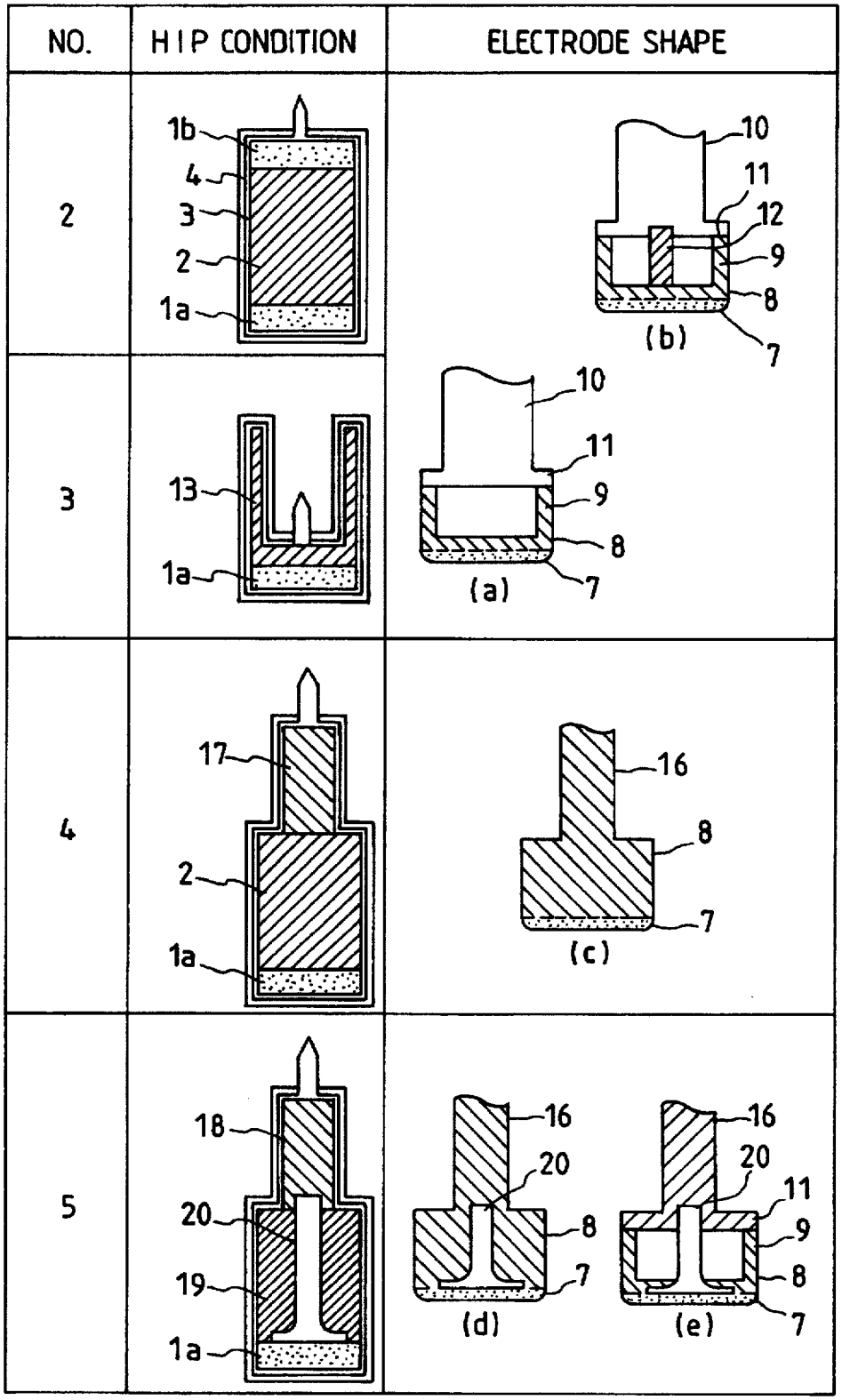
FIG. 11 is a diagram showing HIP processing conditions and the shapes of the electrode structures according to the present invention.

FIG. 11 shows HIP processing conditions and the electrode structure shapes manufactured according to the material obtained by HIP processing. The canning condition and HIP processing conditions were substantially same the conditions shown in Embodiment 1.

In No. 2, the pure Cu rod 2 has a diameter of 80 mm and a length of 120 mm, two mixed compact bodies 1*a* and 1*b* having a diameter of 80 mm and a thickness of 15 mm were prepared. Two mixed compact bodies 1*a* and 1*b* are inserted into a canning vessel 4 along with a, a mold releasing agent 3.

HIP processing temperature was 1000° C. and the holding time was 120 minutes, and other canning condition etc. were substantially same the conditions shown in embodiment 3. By using HIP processing materials obtained thus, (a) type and (b) type electrode structures were manufactured.

In the (a) type electrode structure, an arc electrode member 7, an arc electrode supporting member 8 and a coil electrode member 9 were manufactured to constitute the integral structure, and an electrode rod 10 is joined at a joining portion 11 by the soldering method.

Besides, in the (b) type electrode structure, comparing with the (a) type electrode structure, a reinforcing member 12 comprised of a pure Fe was provided at a center portion. The reinforcing member 12 was brazed to the electrode supporting member 8 and the electrode rod 10.

No. 3, comparing with No. 2, a pure Cu rod 17 having a length of 50 mm was used and the electrode structure was formed with the dent portion. The (a) type and (b) type electrode structures were manufactured using HIP processing material of No. 3.

In No. 4, comparing with No. 2, a pure Cu rod 16 having a diameter of 40 mm and a length of 80 mm was added. Using HIP processing material of No. 4, (c) type electrode structure was manufactured, and it is possible to obtain an integral construction electrode structure including an electrode rod 20 without use of the soldering joining.

Using HIP processing material of No. 4, in addition to the (c) type electrode structure, it is possible to manufacture the (a) type and the (b) type electrode structures by the cutting work.

With respect to (e) type electrode structure, the iron core 20 was casted in place of the reinforcing member 12 of the (b) type electrode structure.

Embodiment 6

Table 2 shows (1) an electric resistance and a strength measurement results (Comparison Example 1) of a joining portion (thickness about 3 μm) in the case that the arc electrode member (composition: 61 Cr wt %-39 Cu wt %) and the pure Cu member were brazed according to the conventional soldering joining method (conditions: temperature of 800° C., in vacuum, Ni system soldering material); (2) an electric resistance and a strength measurement results (Comparison Example 2) the pure Cu which was annealed at the temperature of 800° C.); and (3) an electric resistance and a strength measurement results of HIP processing material which were obtained by No. 6–No. 15 processed by HIP processing at the same conditions of Embodiment 3.

The electric resistance measurement was carried out by a four-point system resistance measurement method and the strength measurement was carried out by using Armsler tensile testing machine. The strength of the interface by the conventional soldering and joining method had the large scattering degree of 12–22 kg/mm$^2$, and a failure soldering portion was observed at a testing plate having a strength of 12 kg/mm$^2$.

Further, the electric resistance including the interface portion was 4.82 μΩ.cm and was a high resistance value of about 3–4 times in comparison with the pure Cu member (Comparison Example 2).

TABLE 2

| | arc electrode composition | Cu alloy composition (wt %) | | | | | | | | electric resistance | tensile test (kg/cm$^2$) | |
|---|---|---|---|---|---|---|---|---|---|---|---|---|
| No. | (wt %) | Cr | Ag | V | Nb | Zr | Si | W | Bt | (μΩ.cm) | $\sigma_{0.1}$(0.2 % yield) | $\sigma_g$(maximum) |
| Comparison Example 1 | 61Cr—39Cu | | | | | | | | | 4.82 (interface) | 4~5 | 12~22 |
| Comparison Example 2 | — | | | | | | | | | 1.73 | 4~5 | 22~23 |
| No. 6 | 61Cr—39Cu | 0.60 | | | | | | | | 1.90 | 9~10 | 20~21 |
| No. 7 | " | 0.11 | | | | | | | | 2.16 | 10~11 | 22~23 |
| No. 8 | " | 1.18 | | | | | | | | 2.50 | 11~13 | 22~23 |
| No. 9 | " | | 0.99 | | | | | | | 1.99 | 9~10 | 22~23 |
| No. 10 | " | | | 0.81 | | | | | | 2.08 | 10~ | 23~24 |
| No. 11 | " | | | | 0.84 | | | | | 2.10 | 10~11 | 24~25 |
| No. 12 | " | | | | | 0.68 | | | | 2.18 | 10~11 | 21~22 |
| No. 13 | " | | | | | | 0.48 | | | 2.21 | 9~8 | 20~21 |
| No. 14 | " | | | | | | | 0.09 | | 1.82 | 5~6 | 20~21 |
| No. 15 | " | | | | | | | | 0.82 | 1.97 | 11~12 | 23~25 |

No. 5 is a combination of Embodiment 1 and Embodiment 3. Namely, during the formation of the pure Cu powder, by inserting a bell type iron core 20 a compact body 19 was prepared, a pure Cu rod 18 was provided on the upper portion of the compact body 19 and the canning processing was carried out.

With respect to the iron core 20, the iron core 20 has a higher melting point than that of Cu, however any shape can be selected.

Using HIP processing material of No. 5, (d) type and (e) type electrode structures were manufactured. The (d) type electrode structure has a shape in which the iron core 20 was casted at a center portion of the (c) type electrode structure.

Comparing with the above, the interface strength of No. 6 was a stable strength of 20–21 kg/mm$^2$ and the defect of the testing plate was not observed.

Comparing with a part member of the arc electrode member in Comparison Example 1 being the pure Cu material, since a part member of No. 6 was Cu alloy containing about 0.6 wt % Cr and the soldering and joining portion did not exist, accordingly the specific resistance is 1.9 μΩ.cm was a lower value than that of Comparison Example 1 and it is suitable for use the electrode structure in the vacuum circuit breaker which flows the large current.

Besides, the strength of the pure Cu in Comparison Example 2 was the maximum value of 22–23 kg/mm$^2$, but the 0.2% yield stress value was very soft value of 4–5 kg/mm$^2$. Accordingly, in the case this pure Cu is used as the arc electrode supporting member or the coil electrode member, such a member does not to bear against the impact load and therefore the member will deform in the lapse of the time.

Besides, in the electric resistance values of Nos. 7–15, which were Cr or Cu alloy containing one or more of Ag, V, Nb, Zr, Si, W, Be, were the resistance values of about 1.5–2.0 times comparing with that of the annealed pure Cu.

Comparing with the resistance value of the soldering and joining interface of the conventional techniques, the above stated values were about less than half, accordingly Nos. 7–15 are possible to fully use for the electrode structure of the actual vacuum circuit breaker.

Further, the strengths of No. 7–15 were the maximum values of 20–25 kg/mm$^2$ and substantially same that of the pure Cu, but 0.2% yield stress values were 9–13 kg/mm$^2$, except for No. 14. Accordingly the strength is improved approximately two times.

As stated in the above, according to the arc electrode supporting member, the coil electrode member and the electrode rod, each of which is comprised of Cr or Cu alloy containing one or more of Ag, V, Nb, Zr, Si, W, and Be according to the present invention, since the deformation due to the repeat of the impact load during the electrode structure opening and closing operation does not occur, the fusion obstacle accompanying with the deformation can be prevented, thereby the reliability and the safety in the electrode structure can be remarkably improved.

Further, the specific resistance increases in accordance with the addition of the alloy element. However, by lessening as much as possible the specific resistance of each of the arc electrode supporting member, the coil electrode member and the electricity supply rod, it is necessary to suppress low the electrode temperature during electricity supply and to cool the arc heat generated by arc generation during the cut-off operation through the electrode rod, thereby it is necessary to heighten the thermal conductivity.

It is preferable to make less than 2.5 μΩ.cm the specific resistance of each of the arc electrode supporting member, the coil electrode member and the electricity supply rod. Further, it is preferable to contain the containing amount of the respective element Cr 1.18%, Ag 1.0%, V 1.0%, Nb 1.0%, Zr 0.8%, Si 0.5%, W 0.1%, Be 1.0% in weight ratio as the upper limitation value.

Embodiment 7

Figure 12:
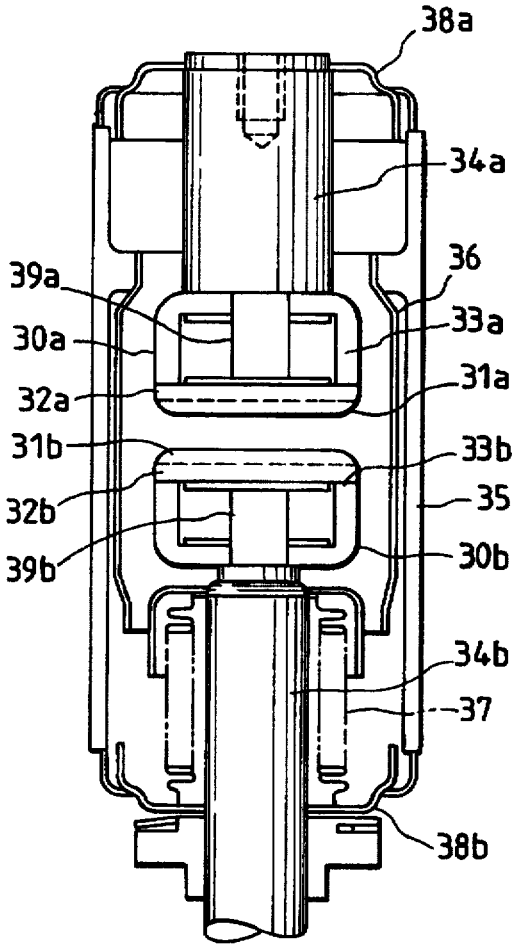
FIG. 12 is a view of one embodiment of a vacuum valve according to the present invention.

FIG. 12 is a cross-sectional view showing a vacuum switch or valve employing an arc electrode member according to the present invention. A vacuum vessel for forming a vacuum chamber constitutes an insulated cylindrical body 35 and an upper terminal plate 38*a* and a lower terminal plate 38*b*. Each of the upper and lower terminal plates 38*a* and 38*b* is respectively provided on an upper and lower opening portion of the insulated cylindrical body 35 formed by an insulating member.

A fixed conductive rod 34*a* is fixedly provided in a middle portion of the upper terminal plate 38*a* and positioned just above a fixed side electrode unit 30*a*. The fixed conductive rod 34*a* forms a part of the fixed side electrode unit 30*a*.

A movable conductive rod 34*b* is slidingly provided in a middle portion of the lower terminal plate 38*b* and positioned just under a movable side electrode unit 30*b*. The movable conductive rod 34*b* forms a part of the movable side electrode unit 30*b*.

A magnetic field generating coil 33*b* and an arc electrode member 31*b* are provided on this movable conductive rod 34*b*. The arc electrode member 31*b* of the movable side electrode unit 30*b* is adapted to move into and out of contact with the arc electrode member 31*a* of the fixed side electrode unit 30*a*. Each of the arc electrode members 31*a* and 31*b* has a diameter of more than of 120 mm.

A metal bellows 37 is positioned around the movable conductive rod 34*b*. The metal bellows 37 is provided to cover and further expands and contracts in an inner surface of the lower terminal plate 38*b*.

A cylindrical shielding member 36 of a metal plate is provided around both arc electrode members 31*a* and 31*b* inside of insulating cylindrical body 35 and this shielding member 36 is constituted so as to not receive the damage of the insulated characteristic of the insulated cylindrical body 35.

Further, each of the arc electrode members 31*a* and 31*b* is integrally fixed to arc electrode supporting members 32*a* and 32*b* which are obtained according to HIP processing and is brazed to the vertical magnetic field generating coils 33*a* and 33*b* by reinforcing member 39*a* and 39*b* comprised of a pure Fe, respectively.

The reinforcing members 39*a* and 39*b* may be comprised of an austenitic stainless steel. The insulated cylindrical body 35 is comprised of glass or a ceramics sintered body.

The insulated cylindrical body 35 is brazed to the upper and lower metal terminal plates 38*a* and 38*b* by an alloy plate which has coefficient of thermal expansion approximately equal to that of the glass or the ceramics such as covar and is maintained under a high vacuum condition of less than $10^{-8}$ mmHg.

The fixed conductive rod 34*a* is connected to a terminal and becomes a passage for the current. An exhaust pipe (not shown in the drawing) is provided on the upper terminal plate 38*a* and during the exhaust operation is connected to a vacuum pump.

A getter is provided so as to work for holding the vacuum when a very small quantity gas generates in an inside portion of the vacuum vessel. The shielding plate 36 works to adhere and cool a metal evaporation of a main electrode surface (the surface of the fixed electrode side unit 30*a* and the surface of the movable side electrode unit 30*b*) generated by the arcs, and the adhered metal works to hold the vacuum degree which has the getter operation.

Figure 13:
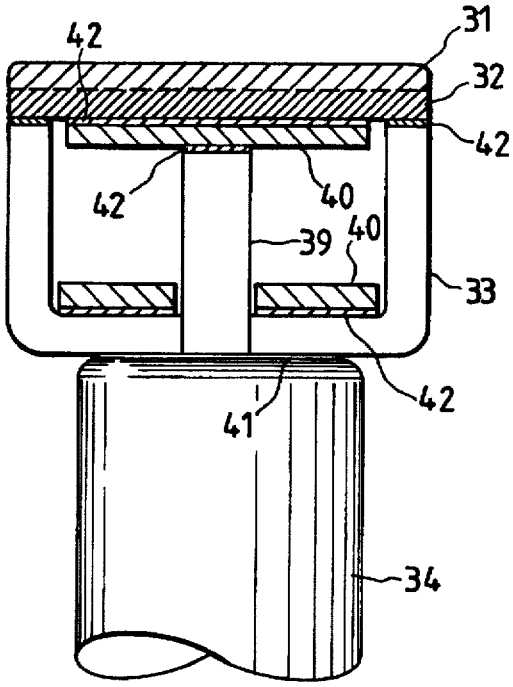
FIG. 13 is a cross-sectional view of one embodiment of an electrode structure according to the present invention.

FIG. 13 is a cross-sectional view showing a detailed electrode structure. Each of the fixed side electrode unit and the movable side electrode structure has substantially same structure. Accordingly the letters a and b used in FIG. 12 are eliminated in FIG. 13.

The arc electrode member 31 is integrally connected with the electrode supporting member 32 according to HIP processing shown in Embodiment 4. The above integral structure is indicated by the broken line as shown in the figure.

A reinforcing flat plate 40 comprised of an austenitic stainless steel is brazed to the arc electrode supporting member 32 using a soldering member 42. The coil electrode member 33 is comprised of the pure Cu and is brazed to the conductive rod 34 and the electrode structure using a soldering member 41 of a lower melting temperature than the above stated soldering member 42, respectively.

The arc electrode supporting member 32 in this embodiment is formed using the pure Cu. The amount of one or more of Cr, Ag, V, Nb, Zr, Si, W and Be to the arc electrode supporting member 32 is stated in the above, and this amount is determined according to the required strength and the required electrical resistance.

Further, it is possible to make small the electric resistance without the lowering in strength according to the eduction of the intermetallic compound by the thermal processing.

Embodiment 8

Figure 5:
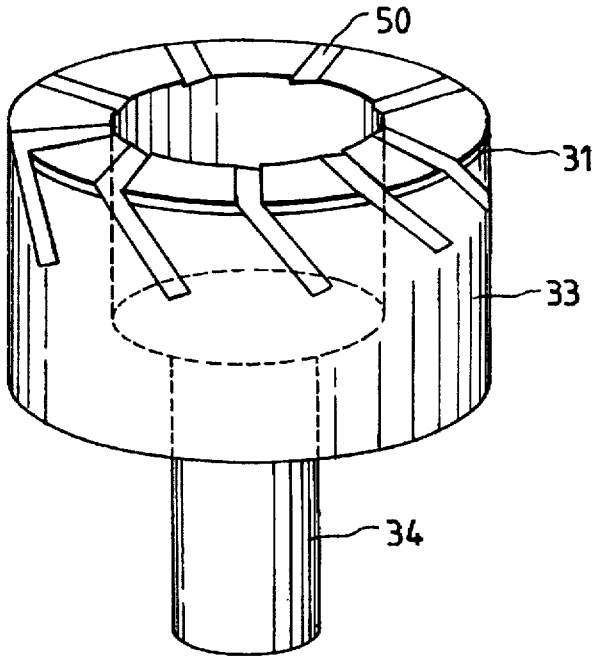
FIG. 5 is a schematic view showing one embodiment of an electrode structure according to the present invention in which plural grooves for generating the vertical magnetic field are continued to extend from an arc electrode member and an arc electrode supporting member.

FIG. 5 is a view showing an electrode structure having grooves extending to a side face portion of an arc electrode member manufactured according to the present invention.

By cutting the grooves extending to the side face portion of the arc electrode member, the strength of the generated vertical magnetic field can be made large.

In this figure, the shape of the arc electrode member differs from that of the arc electrode member shown in FIG. 13 by forming with a circular plate. The above shape of the arc electrode member shown in FIG. 5 is called as a cup type electrode. Even in the electrode structure shown in FIG. 13, by continuously forming the grooves to the upper portion of the arc electrode member, the generation of the vertical magnetic field can be strengthened.

Figure 14:
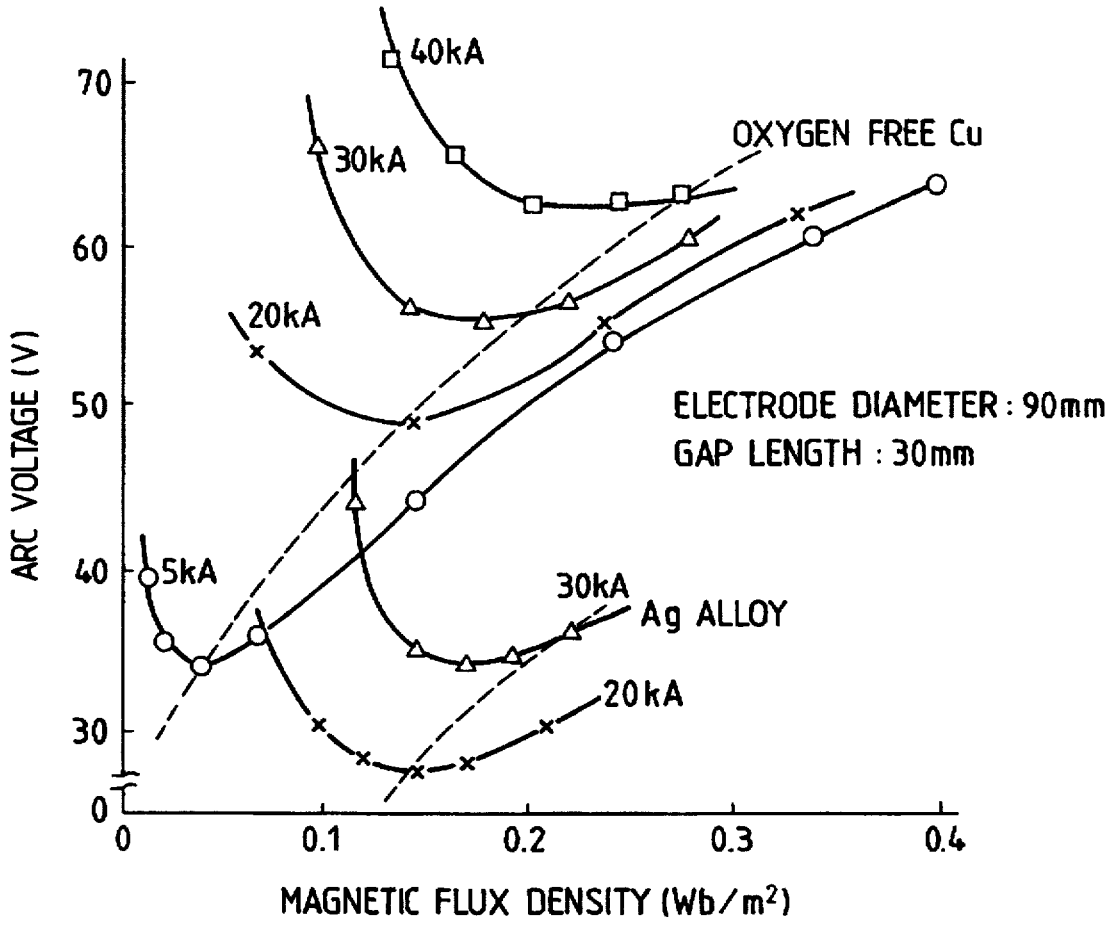
FIG. 14 is a graph showing a relationship between a magnetic flux density and an arc voltage according to the present invention.

In FIG. 14, the relationship between the magnetic flux density and the arc voltage is shown. The arc voltage takes the minimum value by the constant magnetic field which changes by the current. The cut-off current value becomes large and then the magnetic flux density required for minimizing the arc voltage is made large.

In the vacuum circuit breaker for cutting off the large current, it is necessary to have the large vertical magnetic field, however by forming the grooves extending to the side face portion of the electrode structure, in the case in which the arc electrodes member having the same diameter are compared, a larger vertical magnetic field can be obtained in comparison with the conventional electrode structure.

Namely, according to the electrode structure obtained by the present invention, it is possible to attain the compact structure having the same performance.

Figure 1:
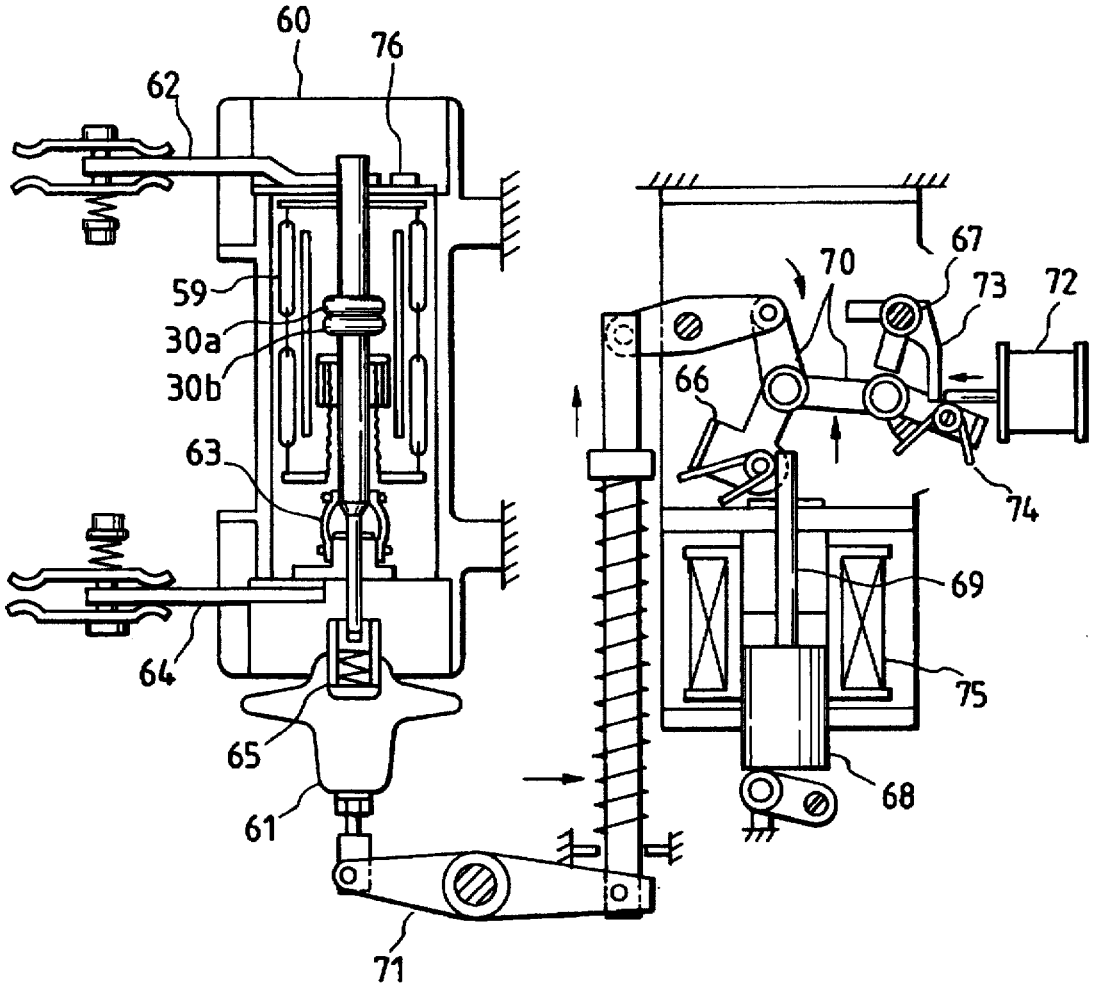
FIG. 1 is a schematic view of one embodiment of a whole vacuum circuit breaker having a vacuum valve according to the present invention.

FIG. 1 shows a schematic view of a whole vacuum circuit breaker structure according to the present invention. In this vacuum circuit breaker, an operation mechanism unit is arranged in a front portion and a three-phase batch type three pairs withstanding tracking epoxy cylinder 60 for supporting a vacuum valve is arranged in a back portion. This vacuum circuit breaker is constituted to have a compact and a light weight structure.

Each of phase ends portions is horizontally supported by an epoxy resin cylinder and a vacuum valve supporting plate and thus the vacuum circuit breaker constitutes a horizontal draw-out type. The vacuum valve is opened and closed by an operation mechanism unit through an operating rod 61.

The operation mechanism unit has a simple structure and forms a compact and a light weight magnetic operating system mechanical draw-takeoff free mechanism. In this operation mechanism unit, since the opening and closing stroke is small and the quantity amount of the movable portions becomes small, the shock can be made small.

In a front side of a main body, in addition to a manual connection system secondary terminal, an opening and closing indicating means, an operation number counter, a manual type draw-takeoff bottom, a manual throwing apparatus, a draw-out apparatus and an interlocking lever etc. are arranged in the vacuum circuit breaker.

(a) Closing-circuit condition

The closing circuit condition of the vacuum circuit breaker is shown. The current flows to an upper terminal 62 of an insulated cylindrical body 59, main electrode units **30*a* and 30*b*, a current collector 63 and a lower terminal 64. The contacting force between the main electrode units 30*a* and 30*b* is held by a contacting spring member 65 which is mounted on the operating rod 61**.

The contacting force of the main electrode units **30*a* and 30*b*, the force by a quick-cutting spring member and magnetic force are maintained by a supporting lever 66 and a prop 67. When a throwing coil is excited, from the opening condition a plunger 68 pushes up a roller 70 through a knocking rod 69. By turning a main lever 71 a contact is closed and the plunger 68 is held by the supporting lever 66**.

(b) Draw-takeoff free condition

In accordance with the opening and separating operation, the movable side electrode unit **30*b* is moved toward the lower portion, the arcs generate from the moment that both of the fixed side and the movable side electrode units 30*a* and 30*b*** are opened and separated.

The arcs are extinguished in a short time by the high insulating and cut-off force and the strong diffusion operation in the vacuum. When a draw-takeoff coil 72 is excited, a draw-off lever 73 takes off the engagement of the prop 67, the main lever 71 is turned by the quick-cutting spring member and then the main electrode units **30*a* and 30*b*** are opened. This operation is a mechanical draw-takeoff free system irrespective of the existence of the closed circuit operation.

(c) Opening circuit condition

After the main electrode units **30*a* and 30*b* are opened, a link is returned back by a reset spring member 74, at the same time the pop 67 engages. In this condition, the throwing coil 75 is excited as it becomes to the (a) closing circuit condition. An exhaust pipe 76** is provided.

The vacuum circuit breaker operates the arc cut-off in the high vacuum condition and it has the high insulating withstanding force of the vacuum and further has a superior cut-off performance according to the high speed diffusion operation of the arcs.

On the contrary, in the case that a motor of no load or a transformer is opened or closed, the cut-off operation is performed before the current reaches the zero point.

However, there are cases in which the cut-off current occurs and an opening and closing surge voltage proportional to the product of the current and the surge impedance occurs.

For the above reasons, when 3 kV transformer and 3 kW or 6 kW rotating machine is directly opened and closed by the vacuum circuit breaker, it is necessary to restrain the surge current by connecting a surge absorber to the circuit and to protect the apparatus.

As the surge absorber, a condenser is commonly employed, however, according to the impact wave withstanding voltage value of the load, a ZnO non-linear resistance body can be employed.

According to the present invention, the vacuum switch or valve or the vacuum circuit breaker has a pair of the fixed side electrode unit and the movable side electrode unit, each of the electrode units comprises the arc electrode member, the arc electrode supporting member for supporting the arc electrode member and the coil electrode member connected to the arc electrode supporting member.

The arc electrode member and the arc electrode supporting member and the coil electrode member, and preferably the electricity supply member or conducting are formed to constitute the integral structure in the by HIP processing. The arc electrode supporting member and the coil electrode member are comprised of Cu alloy containing 1.18–0.1% by weight of one or more of Cu, Ag, V, Nb, Zr, Si, W and Be etc.

Thereby, the mechanical processing process and the assembling process accompanying the soldering joining can be reduced, and also the destruction and the drop out of the electrode member due to the failure in the soldering joining can be prevented.

Further, according to the improvement in strength of the arc electrode supporting member and the coil electrode member, the fusion obstacle accompanying the electrode deformation can be prevented. As a result a vacuum valve having high reliability and high safety or a vacuum circuit breaker having high reliability and high safety can be obtained.

We claim:

1. A vacuum switch comprising:

a vacuum vessel for forming a vacuum chamber;

a fixed side electrode unit provided in said vacuum vessel; and a movable side electrode unit provided in said vacuum vessel;

each of said fixed side electrode unit and said movable side electrode unit being respectively comprised of an arc electrode member, an arc electrode supporting member for supporting said arc electrode member, a coil electrode member and a conducting rod; wherein joining portions between said arc electrode member and said arc electrode supporting member, said coil electrode member and said conducting rod are integrally and directly formed metallurgically by solid phase diffusion using a hot isostatic press process.

2. A vacuum switch according to claim 1, wherein said arc electrode member has a diameter of more than 120 mm.

3. A vacuum switch comprising:

a vacuum vessel for forming a vacuum chamber;

a fixed side electrode unit provided in said vacuum vessel; and a movable side electrode unit provided in said vacuum vessel;

each of said fixed side electrode unit and said movable side electrode unit being respectively comprised of an arc electrode member, an arc electrode supporting member for supporting said arc electrode member, a coil electrode member and a conducting rod; wherein said arc electrode member is comprised of at least one of metal components selected from a group containing 80–30% by weight of one or more of Cr, W, Mo, Co and Fe, or at least one of alloys of metal components selected from a group containing 20–70% by weight of one or more of Cu, Ag and Au, and joining portions between said arc electrode member and said arc electrode supporting member, said coil electrode member and said conducting rod are integrally and directly formed metallurgically by solid phase diffusion using a hot isostatic press process.

4. A vacuum switch comprising:

a vacuum vessel for forming a vacuum chamber;

a fixed side electrode unit provided in said vacuum vessel; and a movable side electrode unit provided in said vacuum vessel;

each of said fixed side electrode unit and said movable side electrode unit being respectively comprised of an arc electrode member, an arc electrode supporting member for supporting said arc electrode member, a coil electrode member and a conducting rod; wherein said arc electrode member is comprised of at least one of metal components selected from a group containing 0.55–5% by weight of one or more of V, Nb, Zr, Ti, Ta and Si, and joining portions between said arc electrode member and said arc electrode supporting member, said coil electrode member and said conducting rod are integrally and directly formed metallurgically by solid phase diffusion using a hot isostatic press process.

5. A vacuum switch comprising:

a vacuum vessel for forming a vacuum chamber;

a fixed side electrode unit provided in said vacuum vessel; and a movable side electrode unit provided in said vacuum vessel;

each of said fixed side electrode unit and said movable side electrode unit being respectively comprised of an arc electrode member, an arc electrode supporting member for supporting said arc electrode, a coil electrode member and a conducting rod; wherein each of said arc electrode supporting member, said coil electrode member and said conducting rod is comprised of at least one of metal components selected from a group containing less than 1.0% by weight of one or more of Cr, V, Zr, Si, W and Be, the remainder being comprised of an alloy of at least one of metal components selected from a group of one or more of Cu, Ag and Au, and joining portions between said arc electrode member and said arc electrode supporting member, said coil electrode member and said conducting rod are integrally and directly formed metallurgically by solid phase diffusion using a hot isostatic press process.

6. A vacuum switch comprising:

a vacuum vessel for forming a vacuum chamber;

a fixed side electrode unit provided in said vacuum vessel; and a movable side electrode unit provided in said vacuum vessel;

each of said fixed side electrode unit and said movable side electrode unit being respectively comprised of an arc electrode member, an arc electrode supporting member for supporting said arc electrode member, a coil electrode member and a conducting rod; wherein each of said arc electrode member and said arc supporting member have a plurality of grooves for generating a vertical magnetic field, said grooves extending to a side face portion of said arc electrode member and said arc electrode supporting member, and joining portions between said arc electrode member and said arc electrode supporting member, said coil electrode member and said conducting rod are integrally and directly formed metallurgically by solid phase diffusion using a hot isostatic press process.

7. A vacuum circuit breaker comprising:

an insulated vessel;

a vacuum switch having a fixed side electrode unit and a movable side electrode unit;

conductive terminals connected to each of said fixed side electrode unit and said movable side electrode unit outside of said vacuum switch;

an insulating member connected to said movable side electrode unit; and an opening and closing means extending through said insulating member for driving said movable side electrode unit;

each of said fixed side electrode unit and said movable side electrode unit being respectively comprised of an arc electrode member, an arc electrode supporting member for supporting said arc electrode member, a coil electrode member and a conducting rod; wherein joining portions between said arc electrode member and said arc electrode supporting member, said coil electrode member and said conducting rod are integrally and directly formed metallurgically by solid phase diffusion using a hot isostatic press process.

8. A vacuum circuit breaker according to claim 7, wherein said arc electrode member has diameter of more than 120 mm.

9. A vacuum circuit breaker comprising:

an insulated vessel;

a vacuum switch having a fixed side electrode unit and a movable side electrode unit;

conductive terminals connected to each of said fixed side electrode unit and said movable side electrode unit outside of said vacuum switch;

an insulating member connected to said movable side electrode member; and an opening and closing means extending through said insulating member for driving said movable side electrode unit;

each of said fixed side electrode unit and said movable side electrode unit being respectively comprised of an arc electrode member, an arc electrode supporting member for supporting said arc electrode member, a coil electrode member and a conducting rod; wherein said arc electrode member is comprised of at least one metal components selected from a group containing 80–30% by weight of one or more of Cr, W, Mo, Co and Fe, or at least one of alloys of metal components selected from a group containing 20–70% by weight of one or more of Cu, Ag and Au, and joining portions between said arc electrode member and said arc electrode supporting member, said coil electrode member and said conducting rod are integrally and directly formed metallurgically by solid phase diffusion using a hot isostatic press process.

10. A vacuum circuit breaker comprising:

an insulated vessel;

a vacuum switch having a fixed side electrode unit and a movable side electrode unit;

conductive terminals connected to each of said fixed side electrode unit and said movable side electrode unit outside of said vacuum switch;

an insulating member connected to said movable side electrode unit; and an opening and closing means extending through said insulating member for driving said movable side electrode unit;

each of said fixed side electrode unit and said movable side electrode unit being respectively comprised of an arc electrode member, an arc electrode supporting member for supporting said arc electrode member, a coil electrode member and a conducting rod; wherein said arc electrode member is comprised of at least one of metal components selected from a group containing 0.5–5% by weight of one or more of V, Nb, Zr, Ti, Ta and Si or at least one of alloys of metal components selected from a group containing 30–70% of one or more of Cu, Ag and Au, and joining portions between said arc electrode member and said arc electrode supporting member, said coil electrode member and said conducting rod are integrally and directly formed metallurgically by solid phase diffusion using a hot isostatic press process.

11. A vacuum circuit breaker comprising:

an insulated vessel;

a vacuum switch having a fixed side electrode unit and a movable side electrode unit;

conductive terminals connected to each of said fixed side electrode unit and said movable side electrode unit outside of said vacuum switch;

an insulating member connected to said movable side electrode unit; and an opening and closing means extending through said insulating member for driving said movable side electrode unit;

each of said fixed side electrode unit and said movable side electrode unit being respectively comprised of an arc electrode member, an arc electrode supporting member for supporting said arc electrode member, a coil electrode member and a conducting rod; wherein each of said arc electrode supporting member, said coil electrode member and said conducting rod is comprised of at least one of metal components selected from a group containing less than 1.0% by weight of one or more of Cr, V, Zr, Si, W and Be, the remainder being comprised of an alloy of at least one of metal components of selected from a group of one or more of Cu, Ag and Au, and joining portions between said arc electrode member and said arc electrode supporting member, said coil electrode member and said conducting rod are integrally and directly formed metallurgically by solid phase diffusion using a hot isostatic press process.

12. A vacuum circuit breaker comprising:

an insulated vessel;

a vacuum switch having a fixed side electrode unit and a movable side electrode unit;

conductive terminals connected to each of said fixed side electrode unit and said movable side electrode unit outside of said vacuum switch;

an insulating member connected to said movable side electrode unit; and an opening and closing means extending through said insulating member for driving said movable side electrode unit;

each of said fixed side electrode unit and said movable side electrode unit being respectively comprised of an arc electrode member, an arc electrode supporting member for supporting said arc electrode member, a coil electrode member and a conducting rod; wherein each of said arc electrode member and said arc electrode supporting member have a plurality of grooves for generating a vertical magnetic field, said grooves extending to a side face portion of said arc electrode member and said arc electrode supporting member, and joining portions between said arc electrode member and said arc electrode supporting member, said coil electrode member and said conducting rod are integrally and directly formed metallurgically by solid phase diffusion using a hot isostatic press process.

* * * * *